United States Patent [19]

Azzalin et al.

[11] 4,076,160

[45] Feb. 28, 1978

[54] PAPER AND CONTINUOUS-FORM FEED SYSTEM FOR A DESK-TOP PRINTING ELECTRONIC CALCULATING MACHINE

[75] Inventors: Bruno Azzalin; Francesco Bettini, both of Ivrea (Turin), Italy

[73] Assignee: Ing. C. Olivetti & C., S.p.A., Ivrea (Turin), Italy

[21] Appl. No.: 720,936

[22] Filed: Sep. 7, 1976

[30] Foreign Application Priority Data

Sep. 11, 1975 Italy ..... 69259/75

[51] Int. Cl.[2] ..... B41J 11/34

[52] U.S. Cl. ..... 226/82; 197/133 P

[58] Field of Search ..... 226/82–85; 197/133 P

[56] References Cited

U.S. PATENT DOCUMENTS

| | | | |
|---|---|---|---|
| 2,293,769 | 8/1942 | Sherman | 197/133 P |
| 2,438,286 | 3/1948 | Huber | 226/83 |
| 2,879,993 | 3/1959 | Scozzafava et al. | 226/82 |
| 3,656,602 | 4/1972 | Konkel et al. | 226/83 |

*Primary Examiner*—Robert W. Saifer

*Attorney, Agent, or Firm*—Schuyler, Birch, Swindler, McKie & Beckett

[57] ABSTRACT

A paper and a continuous-form feed system for a desk-top printing electronic calculating machine comprises a platen, pin elements spaced from the platen and rotatable for driving perforated forms, and a guide support for supporting and conveying the forms towards the pin elements. A pair of guide elements disposed at the sides of the guide support guide the continuous forms laterally. A pair of locating elements, associated with the guide elements, position the forms transversly with respect to the guide support and the pin elements. A container, fixed removably to the calculating machine during the use of the forms, comprises a distributor from which the forms are conveyed toward the machine and a collector in which the forms coming from the machine are accommodated.

7 Claims, 7 Drawing Figures

FIG. 7
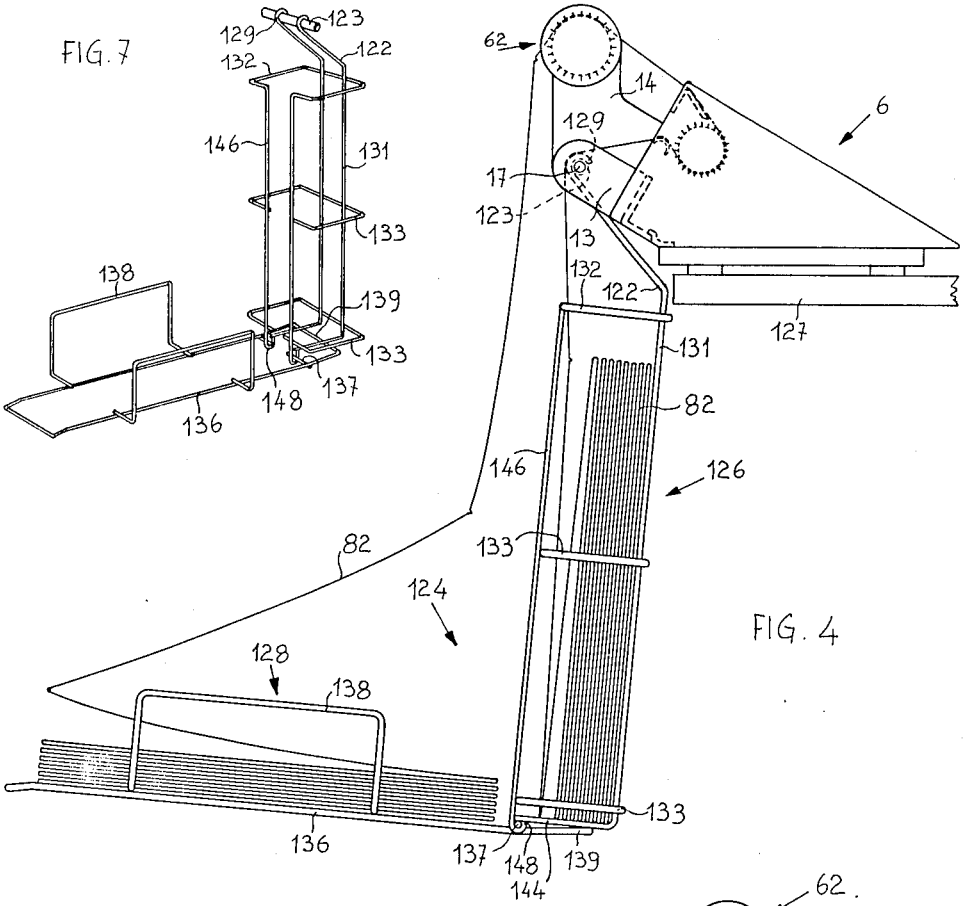
FIG. 4
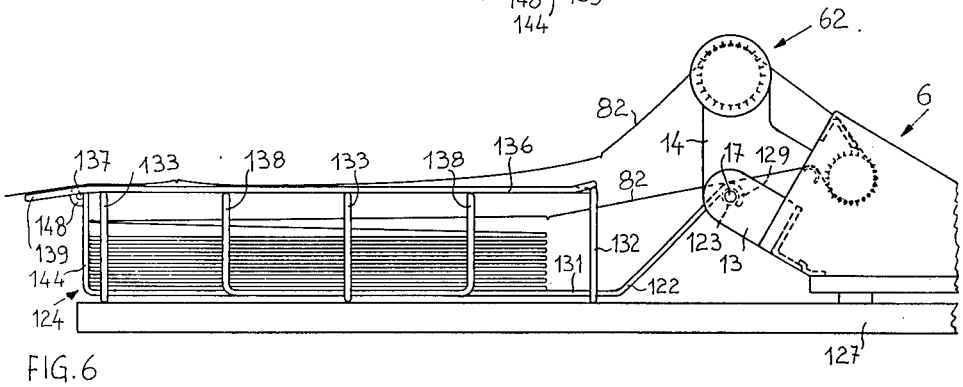
FIG. 6
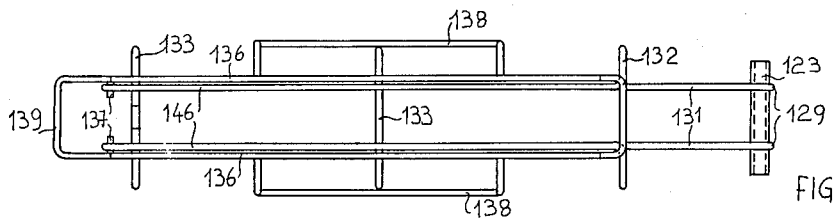
FIG. 5

PAPER AND CONTINUOUS-FORM FEED SYSTEM FOR A DESK-TOP PRINTING ELECTRONIC CALCULATING MACHINE

BACKGROUND OF THE INVENTION

The present invention relates to a continuous-form feed system for a desk-top printing electronic calculating machine.

A feed system is known wherein two pin wheels actuated by a platen through the medium of a toothed belt and a pair of gears feed the continuous forms. Two guides disposed in correspondence with the pin wheels convey the continuous forms towards the respective wheels. The feed is obtained by means of the engagement of the pins in the holes arranged at the sides of the forms so that if the holes are not perfectly aligned because of breaking away of their edges or for other reasons, the forms do not advance parallel to the wheels and, therefore, the lines of print on them will not be aligned with respect to pre-printed lines and boxes on the forms.

SUMMARY OF THE INVENTION

The object of the present invention is, therefore, to provide a feed system which allows perfect alignment of the printing on the continuous forms and which at the same time is simple and, therefore, has a low cost of manufacture.

According to the present invention, there is provided a continuous-form feed system for a desk-top printing electronic calculating machine, comprising a platen, a pin element spaced from the platen and rotatable for driving perforated forms, a guide support for supporting the forms and guiding them to follow a path such that they engage around the pin element, a pair of guide elements disposed at the sides of the guide support and between which the continuous forms are, in use, laterally guided, and a locating element fixed to one of the guide elements adjacent a peripheral portion of the pin element for holding the forms in engagement with the pin element.

BRIEF DESCRIPTION OF THE DRAWING

The invention will be described in more detail, by way of example, with reference to the accompanying drawings in which:

FIG. 4 is a partial side view of a desk-top printing calculating machine with the continuous-form feed system and a form container;

FIG. 5 is a partial plan view of the container of FIG. 4;

FIG. 6 is a side view of the machine of FIG. 4 showing a different use of the container; and FIG. 7 is a perspective view of the container of FIG. 4.

DESCRIPTION OF A PREFERRED EMBODIMENT

Figure 1:
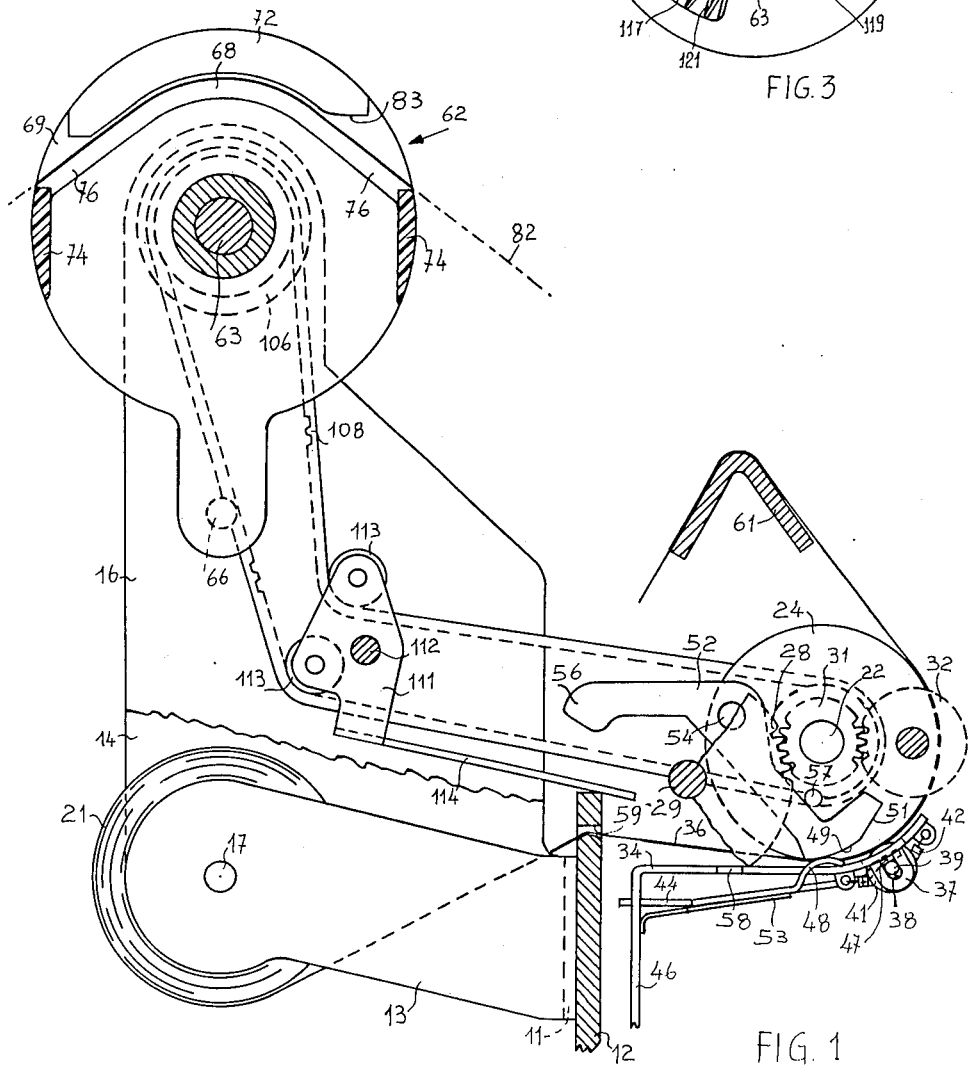
FIG. 1 is a partial side view of a paper and continuous-form feed system embodying the invention.

Referring to FIG. 1, the paper feed system includes a frame 11 fixed by means of screws, not shown, to a part 12 of the base of a desk-top electronic calculating machine. The frame 11 comprises a left side 13, and intermediate wall 14 and a right side 16. Two coaxial roll-supporting pins 17 are respectively supported one on the left side 13 and the other on the intermediate wall 14, but only one pin 17 can be seen in the drawings. The pins 17 are axially slidable in a manner known per se to permit the introduction of an ordinary roll of paper 21.

On a shaft 22 rotatable in sides 23 (FIG. 2) of the base part 12 (FIG. 1) is mounted a platen 24. A positioning detent 26 (FIG. 2) is normally engaged against the teeth of a gear 27 fast with the shaft 22, so that the platen 24 is normally kept positioned angularly. In order to rotate the platen 24 manually, a gear 28 which can turn on a spindle 29 in a side 30 of the base 12 (FIG. 1) is actuated, the gear 28 meshing with a gear 31 on the shaft 22. The platen 24 can be rotated automatically by a command which actuates a mechanism, not shown in the drawings, through the medium of a driving gear 32 meshing with the gear 31.

A guide plate 34 disposed below the platen 24 guides a strip of paper 36 at the bottom towards the platen 24 and has two lugs 37 (FIG. 2) having two slots 38 (FIG. 1) adapted to accommodate a shaft 39. Two paper pressing rollers 41 (FIG. 2) are fast with the shaft 39 and housed in respective cut-outs 43 of the plate 34 and are normally caused to bear against the platen 24 by a spring 42 (FIG. 1).

A plate 44 fulcrumed on a support portion 46 of the plate 34 comprises a lever 47 adapted to co-operate with the shaft 39 and a resilient tongue 48 adapted to co-operate with two cam edges 49 and 51 of a paper release lever 52. A leaf spring 53 urges the resilient tongue 48 up against one of the two edges 49 and 51.

The paper release lever 52 can turn on a pin 54 and includes a grip 56 by means of which it can be turned to assume two positions. In the first position, the lever 52 is arrested against a fixed stop 57 and presents the edge 49 to the resilient tongue 48. The leaf spring 53 holds the plate 44 with the tongue 48 against the edge 49, and the spring 42 holds the rollers 41 against the platen 24. In the second position, the lever 52 is arrested against a lug 58 of the plate 34 and presents the edge 51 to the resilient tongue 48, bending it, so that the plate 44 is rotated and, by means of the lever 47, urges the shaft 39 against the bottom of the slots 38 in opposition to the action of the spring 42, therefore holding the rollers 41 spaced from the platen 24.

The following operations are performed in order to install the roll of paper 21. The roll supporting pins 17 are retracted axially and the roll 21 is arranged coaxially with the pins 17. The pins 17 are now pushed in until the roll 21 is supported and can rotate on the two pins. The paper release lever 52 is arranged in the second position in which the edge 51 bends the resilient tongue 48, keeping the rollers 41 spaced from the platen 24. The strip of paper 36 is passed through a slot 59 in the base part 12 and is inserted between the platen 24 and the guide plate 34 until it is caused to move beyond the rollers 41. The lever 52 is now turned into the first position and the paper 36 is thus clamped between the platen 24 and the rollers 41. Now, either the gear 28 is rotated, or the control of the automatic paper feed mechanism is actuated and causes the driving gear 32 to rotate, thereby feeding the paper 36, which advances to hang back over an inverted V-element 61.

The desk-top printing electronic calculating machine to which the above described paper feed system is applied may also be used for other applications such as, for example, in commercial and administrative areas such as invoicing, pay or wages, money-changing, etc., and in technical and scientific areas such as statistical calculations, civil engineering, etc. For this purpose the calculating machine is provided with a continuous-form feed system which comprises a guide support 62. The support 62 is disposed on a shaft 63 by means of two holes 64 (FIG. 2) and is positioned angularly with respect to the intermediate wall 14 by a pin 66 seated in a hole 67 in the wall 14.

The guide support 62 comprises a central part 68, two first upper guide elements 72 and 73 and two second lateral guide elements 69 and 71, which are spanned by the central part 68 and which are substantially perpendicular to the respective upper elements 72 and 73.

The central part 68 (FIG. 1) comprises an upper wall of substantially cylindrical form coaxial with the shaft 63, and two transverse plates 74 which are fast at the ends with the lateral guide elements 69 (FIG. 2) and 71, and two inclined walls 76 (FIG. 1) which are connected or united with the upper wall 68, rendering it fast with the plates 74. Each lateral element 69, 71 (FIG. 2) is substantially perpendicular to the central part 68 and defines a seat 78, 79, respectively, adapted to accommodate a pin element or sprocket wheel 81.

Each of the upper guide elements 72 and 73 has the form of a substantially circular sector concentric with the central part 68 (FIG. 1), so as to define a limited zone for the passage of a continuous form 82 represented in dots and dashes. The forms 82 may be multiple forms in order to obtain several copies. Each of the upper elements 72 and 73 has an end 83, suitably shaped to provide a flared entry for the introduction of the continuous forms 82. Moreover, each of the upper elements 72 and 73 projects over its respective seat 78, 79 (FIG. 2) and comprises a groove 86, 87, respectively, for accommodating pins 88 of the sprocket wheel 81. In addition, the upper element 73 comprises a seat 89 of substantially semi-circular form for accommodating a knob 91.

The shaft 63 is rotatable in a hole 92 in the intermediate wall 14 and in a hole 93 in the right side 16 and, at the end opposite the side 16, has the knob 91 with its outer surface milled for being gripped and rotated manually. The sprocket wheel 81 may be fixed to the shaft 63 in correspondence with one of the two seats 78 and 79 so as to permit the use of continuous forms 82 (FIG. 1) having the holes for the feed either on the right-hand edge or on the left-hand edge. In the example shown in the drawings, the sprocket wheel 81 (FIG. 2) is accommodated in the seat 79 and the continuous forms 82 (FIG. 1) have the holes on the left-hand edge. Since the wheel 81 is fixed on the shaft 63 and the pins 88 engage in the groove 86 or 87, the guide support 62 is coaxially positioned correctly on shaft 63.

Figure 2:
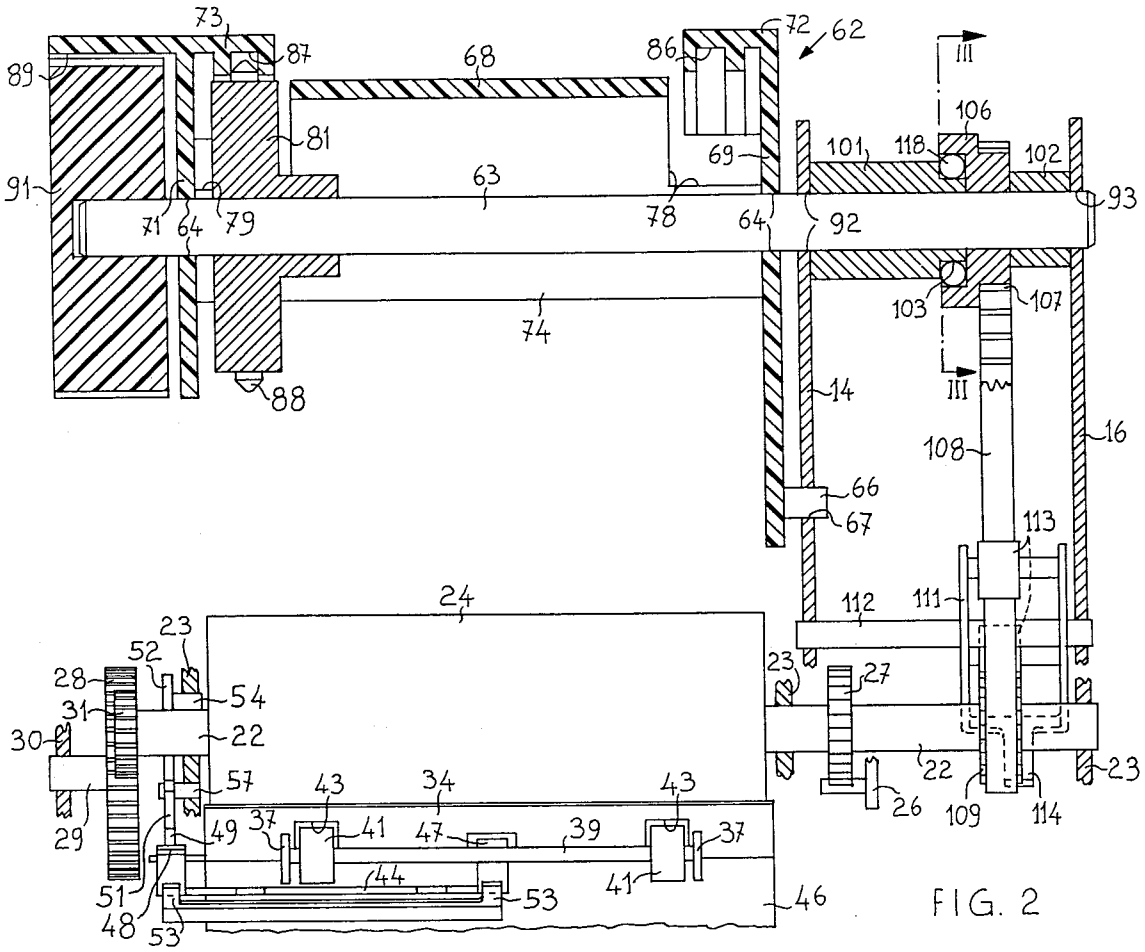
FIG. 2 is a partial front view of the system of FIG. 1.

Two sleeves 101 and 102 (FIG. 2) are mounted, fast with the shaft 63, between the intermediate wall 14 and the right side 16 so as to prevent axial sliding of the shaft 63. The sleeve 101 has a hub 103 housed in a cylindrical seat 104 (FIG. 3) of a driven gear 106 rotatably loosely on the shaft 63 between the two sleeves 101 and 102 (FIG. 2). The driven gear 106 has on its outer surface a toothing 107 meshing with a toothed belt 108 fitted between the gear 106 and a driving gear 109 fast with the shaft 22 of the platen 24. A belt tensioner 111 can turn on a spindle 112 fast with the wall 14 and the side 16 and co-operates with the toothed belt 108 through two rollers 113 (FIG. 1). The belt tension 111 has a tongue 114 bearing against the base part 12. When the tongue 114 is bent upwardly or downwardly, the belt tensioner 111 is made to turn clockwise or anti-clockwise about the spindle 112 and thus regulates the tension of the toothed belt 108 by means of the rollers 113.

Figure 3:
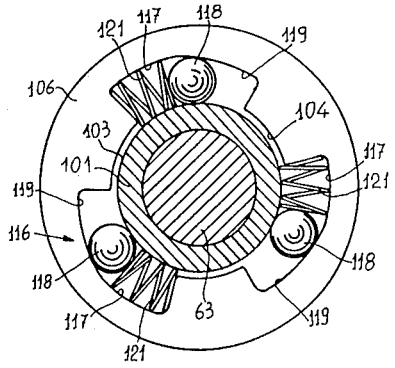
FIG. 3 is a section on the line III—III of FIG. 2 on a larger scale.

The driven gear 106 (FIG. 3) is connected to the hub 103 of the sleeve 101 (FIG. 2) through a ball coupling 116 (FIG. 3). The coupling 116 comprises three slots 117 formed in the interior of the gear 106, disposed at 120° one from the other and adapted to house as many balls 118 slidable on the outer surface of the hub 103. Each slot 117 has a cylindrical profile, coaxial with the shaft 63, which terminates with a wedge-shaped profile 119. A spring 121 housed in each slot 117 urges the respective ball 118 towards the wedge-shaped profile 119. Thus, by acting on the feed mechanism (not shown in the drawings), the platen 24 (FIG. 1) is rotated, as hereinbefore described, and, through the medium of the toothed belt 108, causes the driven bear 106 to rotate. The balls 118 (FIG. 3) engage the respective wedge-shaped profiles 119 and, therefore, render the gear 106 fast with the shaft 63, causing it to rotate with the sprocket wheel 81 (FIG. 2). If, on the other hand, the shaft 63 is rotated manually by acting on the knob 91, the balls 118 are disposed in the cylindrical profiles and the gear 106 therefore remains loose with respect to the shaft 63. Sufficient restraint to prevent the gear 106 rotating with the shaft 63 is provided by the tension of the toothed belt 108 plus the action of the positioning detent 26 on the gear 27.

The following operations are performed in order to install the continuous forms 82 (FIG. 1). The paper release lever 52 is arranged in the second position, in which the edge 51 bends the resilient tongue 48, keeping the paper pressing rollers 41 spaced from the platen 24. The end of the continuous form 82 is passed through the slot 59 and then between the platen 24 and the guide plate 34 until it moves beyond the inverted V-element 61 to be introduced below the ends 83 of the upper elements 72 and 73 (FIG. 2), between the lateral guides 69 and 71, resting it on the central part 68. The form 82 is advanced until the pins 88 of the sprocket wheel 81 are engaged with the feed holes of the form 82. The knob 91 is now turned manually to cause the form 82 to advance in order to align the line on which it is desired to print with the printing point of the electronic calculating machine. The continuous form 82 is thus engaged by the pins 88 of the sprocket wheel 81, being guided laterally and at the top by the elements 69, 71, 72 and 73, and therefore to each command to advance of the platen 24 there will correspond a similar advance or feed of the continuous forms 82.

The desk-top printing electronic calculating machine may, therefore, be employed either with the paper feed system for conventional calculation, for accounting or book-keeping fields, as a microcomputer, etc., or with the continuous-form feed system for commercial, administrative, technical, scientific, etc. fields.

It is, therefore, obvious that the second guide elements 69 and 71 guide the continuous forms 82 laterally and that each upper guide element 72, 73 and the corresponding second element 69, 71 are fast with one another and an integral part of the guide support 62 in which the pin element 81 is rotatable. Since the forms run between the guide elements 69 and 71, they cannot skew.

Referring to FIG. 4, the reference 6 indicates the printing electronic calculating machine supported on a working surface 127. The axially slidable pins 17 can be used to support per se and, as an alternative, permit the introduction of the container 124 for continuous forms 82, which has at the top a socket tube 123 for receiving the pins 17.

The container 124 comprises a distributor 126 adapted to contain the forms 82 which are conveyed towards the machine 6, and a collector 128 adapted to accommodate the forms 82 coming from the machine 6. The distributor 126 and the collector 128 are formed by rigid wires suitably shaped and welded together.

More particularly, the distributor 126 has a substantially parallelepipedal form and comprises the socket tube 123, which is welded to two bent portions 129 (FIG. 5) of an inner frame 131 formed by two wires which are substantially rectilinear and parallel to one another. Each lower wire 131 has an intermediate bend 122 (FIG. 4) of about 135° and a bottom bend of 90° adapted to define a flat part 144 on which the continuous forms 82 rest. The distributor 126 also comprises an outer frame 146 formed by two substantially rectilinear wires parallel to one another and to the lower frame 131. Each wire 146 has a lower end bent in the form of a 'U' so as to define a seat 148 with the end of the flat part 144. Each wire 146 has at the top end a 90° bend (FIG. 5) so as to be connected to a rectangular frame 132 substantially perpendicular to the wires 131 and 146.

Finally, the distributor 126 comprises two rectangular frames 133 one of which is fitted near the bottom of the wires 131 and 146 and the other about halfway between this frame and the frame 132. The two frames 133 and the frame 132 constitute the sides of the distributor 126.

The collector 128 is formed by a rectangular frame 136 (FIG. 5) having two pins 137 accommodated in the seats 148 (FIG. 4) of the distributor 126 and two L-sides 138 (FIG. 5). The forms 82 (FIG. 4) rest on the frame 136, being guided laterally by the sides 138. The pins 137 and the seats 148 hinge the collector 128 to the distributor 126. The collector 128 can, therefore, swing from a first position in which it is parallel to the distributor 126, as shown in FIG. 6, to a second position in which it is perpendicular to the distributor 126 as in FIG. 7. Part 139 of the frame 136 projecting beyond the pins 137 then bears against the flat part 144 of the inner frame 131.

The container 124 (FIG. 4) is hung on the supporting pins 17 and is arranged with the distributor 126 below, aligned with the guide support 62, with the collector 128 in the operative position perpendicular to the distributor 126. In order to reduce the space occupied when no operation is being carried out on the machine 6, the collector 128 is swung up against the distributor 126.

Among possible modifications, FIG. 6 shows a different use of the container 124. It is used here essentially in its role of distributor, with the frame 131 resting horizontally on the working surface 127, so as to enable the forms 82 to be kept aligned with the system 62 even in the event of the machine being shifted with respect to the surface 127. The continuous forms feed back on to the container.

What we claim is:

1. A continuous-form feed system for a desk-top printing electronic calculating machine, comprising a platen, a pin element spaced from the platen and rotatable for driving perforated forms, a guide support for supporting the forms and guiding them to follow a path such that they engage around the pin element, a pair of guide elements disposed at the sides of the guide support and between which the continuous forms are, in use, laterally guided, and a locating element fixed to one of the guide elements adjacent a peripheral portion of the pin element for holding the forms in engagement with the pin element, wherein the guide support for the forms comprises a central part of substantially cylindrical form on which the continuous forms rest, in use, and wherein the locating element has the form of a concave circular sector substantially concentric with the central part and confronting the pin element so as to define a limited gap for the passage of the continuous forms.

2. A feed system according to claim 1, wherein the locating element is shaped to form a flared mouth facilitating introduction of the continuous forms.

3. A feed system according to claim 1 wherein the said central part is fixed between the two guide elements by two transverse plates connected to the central part through two inclined walls forming continuations of the cylindrical central part.

4. A feed system according to claim 1 wherein the locating element has a groove accommodating the pins of the pin element.

5. A feed system according to claim 4, wherein the guide support, guide elements and locating element are integral with each other and are mounted with axial play but are axially located by virtue of engagement of the pins in the groove.

6. A feed system according to claim 5 wherein there are two locating elements fixed to the two guide elements respectively and the pin element is positionable adjacent either guide element to cooperate with continuous forms edge-perforated on their left-hand or right-hand side.

7. A continuous-form feed system for a desk-top printing electronic calculating machine, comprising a plate, a pin element spaced from the platen and rotatable for driving perforated forms, a guide support for supporting the forms and guiding them to follow a path such that they engage around the pin element, wherein the platen is adapted to rotate by a predetermined amount to cause a roll of paper to advance and wherein the said pin element is mounted fast with a shaft on which is rotatable a gear connected for rotation to the platen, the guide support being supported by the said shaft and positioned angularly with respect to the frame of the machine by a pin seated in a hole in the frame, wherein the shaft is connected to the gear through a one-way coupling, and one of the guide elements comprises a seat of substantially circular form accommodating a knob fast with the shaft for rotating the pin element manually.

* * * * *